US005090752A

United States Patent [19]

Jans

[11] Patent Number: 5,090,752

[45] Date of Patent: Feb. 25, 1992

[54] DOOR LATCH DEVICE WITH RECIPROCATABLY MOVEABLE PRIVACY LOCK CONTROL MEMBER

[75] Inventor: Franz W. Jans, Roedermark, Fed. Rep. of Germany

[73] Assignee: JADO Design Armatur und Beschlag Aktiengesellschaft, Roedermark, Fed. Rep. of Germany

[21] Appl. No.: 600,305

[22] Filed: Oct. 19, 1990

Related U.S. Application Data

[63] Continuation-in-part of Ser. No. 466,993, Jan. 18, 1990, Pat. No. 4,997,220, which is a continuation-in-part of Ser. No. 392,564, Aug. 11, 1989, Pat. No. 4,974,883.

[51] Int. Cl.[5] ..... E05L 1/08

[52] U.S. Cl. ..... 292/169.16; 292/359

[58] Field of Search ..... 292/169–169.22, 292/166, 150, 359

[56] References Cited

U.S. PATENT DOCUMENTS

| | | | |
|---|---|---|---|
| 2,268,973 | 1/1942 | Voignt | 292/169.16 |
| 2,407,133 | 9/1946 | Gere | 292/359 |
| 2,412,789 | 12/1946 | Voignt | 292/359 |
| 2,420,083 | 5/1947 | Lickteig | 292/169.16 |
| 2,420,113 | 5/1947 | Vander Henst | 292/169.16 |
| 2,431,814 | 12/1947 | Lickteig | 292/169.16 |
| 2,486,268 | 10/1949 | Erkkila | 292/359 |
| 2,687,133 | 8/1954 | Quigley et al. | 292/169.16 |
| 3,361,462 | 1/1968 | Foster | 292/359 |
| 4,575,137 | 3/1986 | Jans | 292/337 |

*Primary Examiner*—Eric K. Nicholson
*Attorney, Agent, or Firm*—H. Michael Brucker

[57] ABSTRACT

A latch device including a privacy lock control member reciprocatably moveable along a first predetermined path of movement, a manually operable member for reciprocatably moving said control member in a direction generally opposed to the direction of movement of the manually operable member, and a lock member for selectively allowing actuation of the privacy lock by pushing the manually operable member from only one preselected end thereof.

6 Claims, 4 Drawing Sheets

DOOR LATCH DEVICE WITH RECIPROCATABLY MOVEABLE PRIVACY LOCK CONTROL MEMBER

This application is a continuation-in-part of copending U.S. patent application Ser. No. 466,993, filed Jan. 18, 1990 now U.S. Pat. No. 4,997,220, which is a continuation-in-part of U.S. patent application Ser. No. 392,564, filed Aug. 11, 1989 now U.S. Pat. No. 4,974,883.

TECHNICAL FIELD

This invention relates to a latch device for doors and, more particularly, to a latch device which incorporates a mechanism enabling the operator to actuate a privacy lock feature by pushing an outwardly accessible member rather than pulling a member as would normally be dictated by the interior mechanism of the latch device. The mechanism incorporates structure which allows actuation of the privacy lock from a preselected side of the door by restricting movement of the member. More specifically, the mechanism includes an arrangement which permits the member to be pushed to actuate the privacy lock from a particular side of the door established at the time of installation of the latch device. This is readily accomplished by suitable positioning of locking elements incorporated in the latch device upon installation.

BACKGROUND ART

Co-pending U.S. patent application Ser. No. 392,564 now U.S. Pat. No. 4,974,883 filed Aug. 11, 1989, relates to an improved latch device for doors. More particularly, the application discloses a latch device characterized by relative simplicity and compact size. Such latch device incorporates structure enabling it to be utilized as a passage latch actuatable from both sides of the door with which it is associated or, alternatively, as a privacy locking system which is selectively adjustable by the operator to permit handle or doorknob actuation from only one side of the door.

While the latch device just described in general terms has a number of desirable features, it incorporates an externally actuatable control member which must be pulled, rather than pushed, to utilize the privacy lock feature.

The invention disclosed in U.S. patent application Ser. No. 466,993 now U.S. Pat. No. 4,997,220 relates to a latch device generally of the type disclosed in the aforesaid U.S. patent application Ser. No. 392,564 now U.S. Pat. No. 4,974,883. However, the latch device of U.S. patent application Ser. No. 466,993 now U.S. Pat. No. 4,997,220 incorporates structure adding to the overall convenience and ease of use thereof.

More specifically, the latch device disclosed in U.S. patent application Ser. No. 466,993 now U.S. Pat. No. 4,997,220 incorporates structure enabling the privacy lock feature to be actuated by a push, rather than pull, manual motion. It will be appreciated that privacy locks are conventionally actuated by push, rather than pull, and failure to adhere to this convention can confuse the user, resulting in deactuation of the privacy lock when actuation is desired and vice versa.

DISCLOSURE OF INVENTION

The present invention is an improvement over the latch device shown in U.S. patent application Ser. No. 466,993 now U.S. Pat. No. 4,997,220 and in common therewith the latch device of the present invention includes a housing having opposed sides and defining an interior and an opening at one end of the housing communicating with said interior.

A latch element is disposed in said housing interior and includes a latch body and a latch head, said latch element movable between an extended position and a retracted position.

Means is operatively associated with the latch element for moving the latch element from said extended position to said retracted position, said latch element moving means including first and second actuator mechanisms selectively operatively associated with said latch element to move said latch element to said retracted position.

A reciprocatable control member is movable along a first predetermined path of movement extending between said housing opposed sides for controlling which of said actuator mechanisms is operatively associated with said latch element.

In the present arrangement, a mounting member is attached to said housing and defines spaced apertures. A shaft projects through said spaced apertures and is manually accessible from outside said mounting member for moving said control member, said shaft being mounted on said mounting member for axial reciprocatable movement in a direction generally opposed to the direction of movement of said control member.

The present invention further includes lock means operatively associated with said mounting member and shaft for selectively preventing at least one of said actuator mechanisms from being operatively associated with said latch element.

Other features, advantages, and objects of the present invention will become apparent with reference to the following detailed description and accompanying drawings.

BEST MODE FOR CARRYING OUT THE INVENTION

Figure 1:
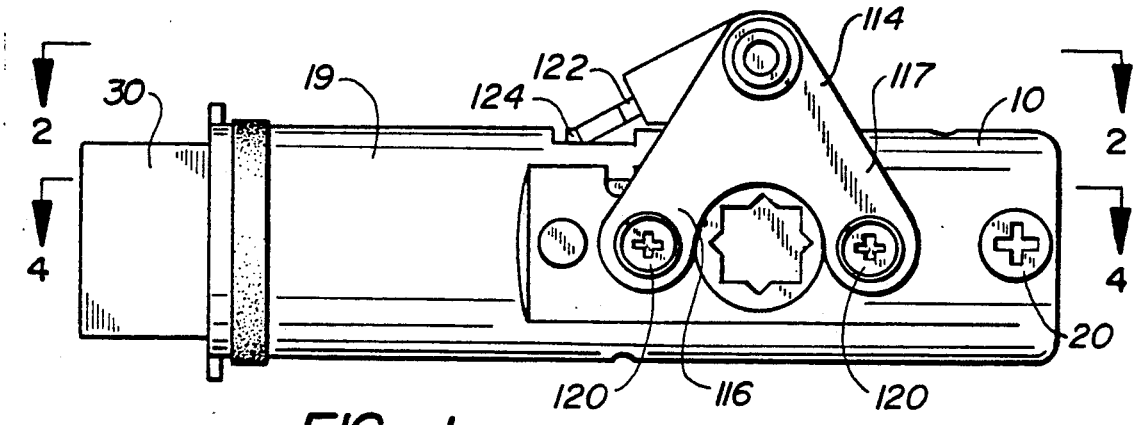
FIG. 1 is a side view of a latch device constructed in accordance with the teachings of the present invention.

Referring now to the drawings, a latch device constructed in accordance with the teachings of the present invention is illustrated and includes a housing 10 defining an interior 12. An opening 14 is disposed at one end of the housing and communicates with the housing interior.

The housing is comprised of two housing segments 16, 18 secured together by any suitable means such as a screw 20 which has threads engaging mating threads in housing segment 16. Segment 16 includes a wall 17 and segment 18 includes a wall 19 opposed thereto.

A latch element 22 is disposed in housing interior 12 and includes a latch body 24 and a latch head 26. As is conventional, the latch head includes a generally tapered surface 28 and a substantially flat abutment surface 30. The latch head is enlarged as at 32 and a circular-shaped boss 34 projects therefrom. Boss 34 is disposed within a recess 36 of generally corresponding configuration formed in latch body 24.

A coil compression spring 44 has one end thereof disposed in a recess 45 formed in the latch body 24. The other end of spring 44 engages wall member 46 and surrounds a circular-shaped projection 48 integral with the wall member. As may perhaps best be seen with reference to FIG. 4, wall member 46 is prevented from moving toward the right as viewed in that figure because it is in engagement with a peripherally extending abutment surface 5 defined by the housing.

Spring 44 continuously urges the latch element 22 to the left as shown in FIGS. 1, 2, 3 and 4. The latch element is linearly reciprocatably moveable relative to housing 10 between an extended position whereat the head projects from the housing interior through opening 14 and a retracted position whereat the head is substantially completely retracted in the housing interior.

Means is operatively associated with the latch element for moving the latch element from the extended position to the retracted position. The latch element moving means includes actuator mechanisms including cam means rotatably mounted relative to the housing and adapted to be rotated by means accessible outside the housing. In particular, the cam means includes two relatively moveable cam elements 52, 54 disposed side by side within the housing. Each cam element includes a round boss 56 which projects through a corresponding hole formed in one of housing segments 16, 18 whereby the cam elements are maintained in position and yet are rotatable to a predetermined degree within the housing.

Each cam element defines a channel 58, the channels 58 being curved and accommodating therein double-ended coil compression springs 60. One end of each coil compression spring engages an indent 62 formed in the housing wall. With specific reference to FIG. 3, it will be seen that cam element 52 is continuously biased by its associated spring 60 in a counter clockwise direction as viewed in that figure. The same, of course, holds true for cam element 54. Engagement between the ca elements and the wall of the housing limits such rotation and springs 60 are always maintained under compression.

Each cam element includes a lobe 64 engageable with a transmission arm 70. More specifically, the lobes 64 are engageable with a first projection 72 of said transmission arm. The transmission arm 70 is pivotally mounted on a pin 74 which extends between support recesses formed at spaced locations in the housing wall.

Transmission arm 70 also includes a second projection 76 which engages latch body 24. Again making specific reference to FIG. 3, clockwise rotation of a cam element having its lobe 64 in engagement with the first projection 72 causes the transmission arm 70 to rotate in a counter clockwise direction. This action causes the latch element 22 to move against the compression of spring 44 and retract.

Figure 4:
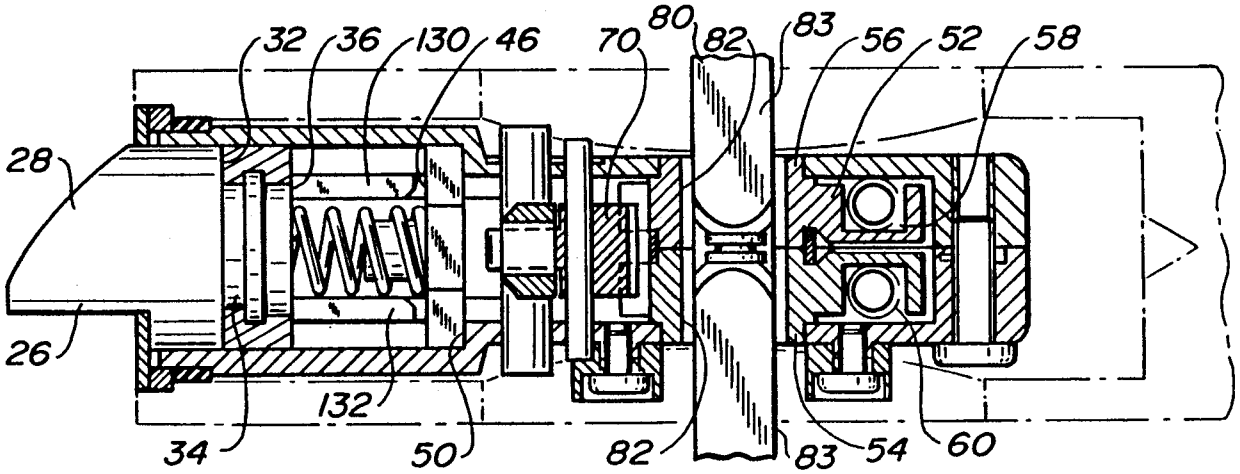
FIG. 4 is a plan, sectional view taken along line 4—4 of FIG. 1, illustrating the latch device in a door.

In FIG. 4, a portion of a shaft 80 is shown. Such shaft projects completely through the housing 10, passing through apertures 82 formed in the cam elements at the location of bosses 56. It will be appreciated that the shaft 80 has attached at the opposite ends thereof manually manipulable elements such as lever handles or doorknobs.

Shaft 80 is comprised of two relatively rotatable shaft components 83 connected together by a connector which allows the shaft components to be individually rotated by their respective associated knobs or levers. A shaft of this type, which is split into two parts capable of independent movement, is known in the prior art and will not be described in detail.

When transmission arm 70 is in the position illustrated in FIG. 4, there is engagement between the lobes 64 of both cam elements 52, 54 and first projection 72 of the transmission arm. Thus, rotation of either of the cam elements 52, 54 by shaft components 83 will result in pivoting of the transmission arm and retraction of the latch element 22. The latch device, however, can be readily adjusted to permit latch element retraction by either of the cam elements to the exclusion of the other. In other words, the latch device has a built-in privacy locking feature. This will now be described.

Figure 3:
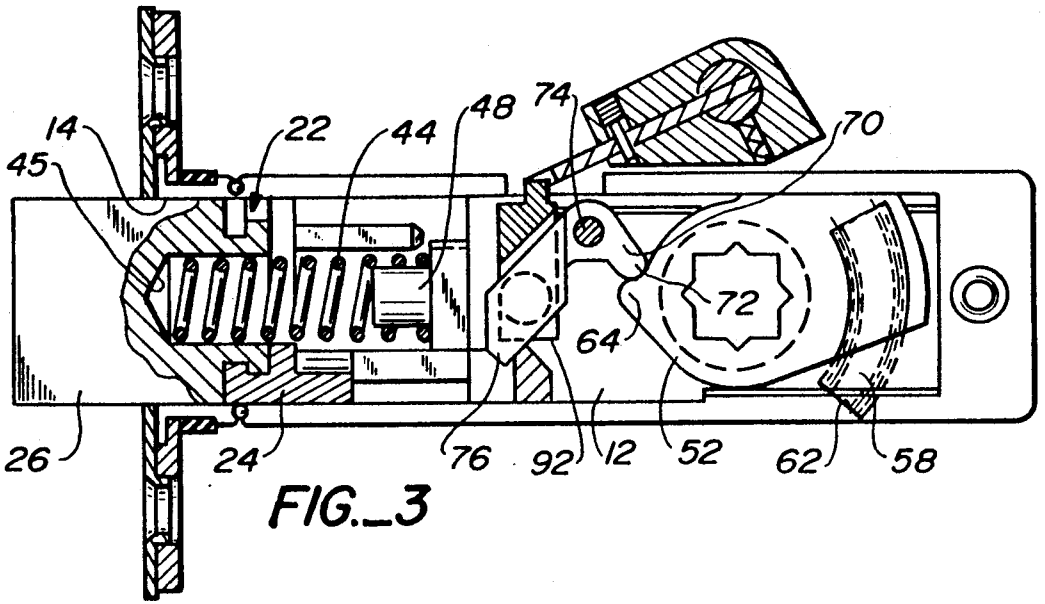
FIG. 3 is a side elevation, cross-sectional view of the latch device taken along the line 3—3 in FIG. 2.

Disposed immediately adjacent to transmission arm 70 is a control member 84 including a control element 86 and spindles 88, 90 projecting from opposed sides of the control element. The control element 86 includes two legs 92, one of which is shown in FIG. 3. Second projection 76 of transmission arm 70 is disposed between the two legs.

It will be appreciated that lateral movement of control element 88, i.e. movement along the axis of spindles 88, 90, causes a corresponding lateral movement of the transmission arm 70. When displacement is in the direction of spindle 90, the first projection 72 of the transmission arm is in engagement with lobe 64 of cam element 54. Rotation of cam element 54 will cause retraction of the latch element 22 but rotation of cam element 52 will not.

Just the opposite condition exists when the control member and transmission arm have been displaced in the direction of spindle 88 and first projection 72 is engaged only by the lobe on cam element 52. In this latter situation, only cam element 52 is effective to cause retraction of the latch element.

The structural arrangement just described is essentially shown in aforesaid U.S. patent application Ser. No. 392,564 now U.S. Pat. No. 4,974,883. In such arrangement, if one wishes to activate the privacy lock feature from a particular side of the housing 10 the spindle (either spindle 88 or spindle 90) must be pulled. For example, assuming that the spindles are the structural elements employed to manually actuate the privacy lock feature, spindle 88 would have had to been pulled for it to have assumed the position shown in FIG. 2. That is, someone on the side of the door corresponding to spindle 88 would have had to pull that particular spindle to prevent the latch device from being actuated by a person on the opposite side of the door, i.e. the side of the door corresponding to spindle 90.

This approach has caused difficulties for some users. First of all, in most prior art latch devices, a privacy lock is actuated by pushing in, rather than pulling out, the element which brings the privacy lock feature into operation. Also, it is, of course, much easier to push in spindles 88, 90 rather than to manually grasp them and attempt to pull them outwardly.

The structure disclosed in U.S. patent application Ser. No. 466,993 now U.S. Pat. No. 4,997,220 incorporates all of the advantages of the latch device of U.S.

patent application Ser. No. 392,564 now U.S. Pat. No. 4,974,883 but allows the privacy lock feature thereof to be actuated by a manually actuatable element which is pushed, rather than pulled, relative to the housing.

In common with the latch device disclosed in U.S, patent application Ser. No. 466,933 now U.S. Pat. No. 4,997,220 the present latch device includes a manually operable member accessible from outside the housing opposed sides for moving the control member. The manually operable member is mounted on the housing for reciprocatable movement in a direction generally opposed to the direction of movement of control member 84 which, of course, includes control element 86 and spindles 88, 90. The manually operable member is in the form of a shaft 110.

Figure 2:
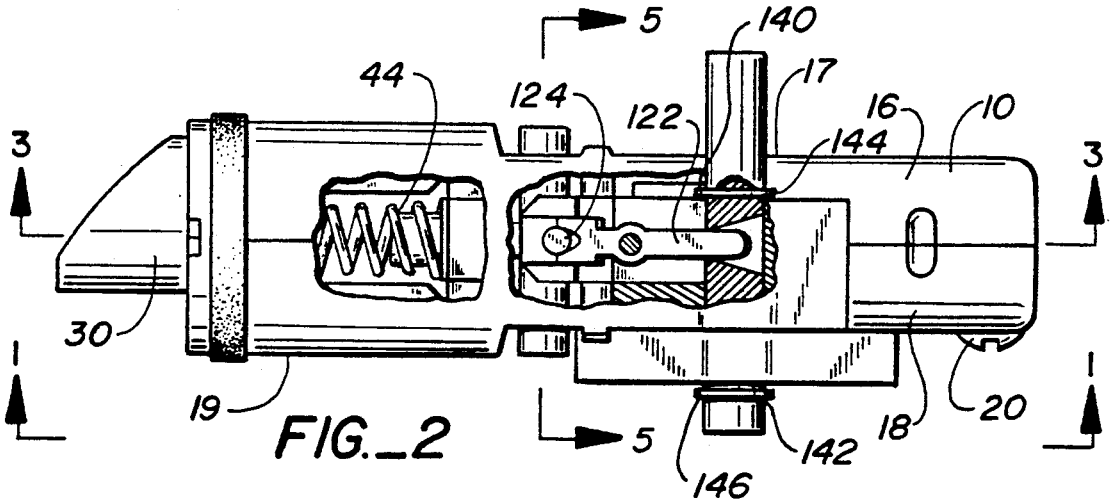
FIG. 2 is a plan view of the latch device with a portion thereof broken away.
Figure 2A:
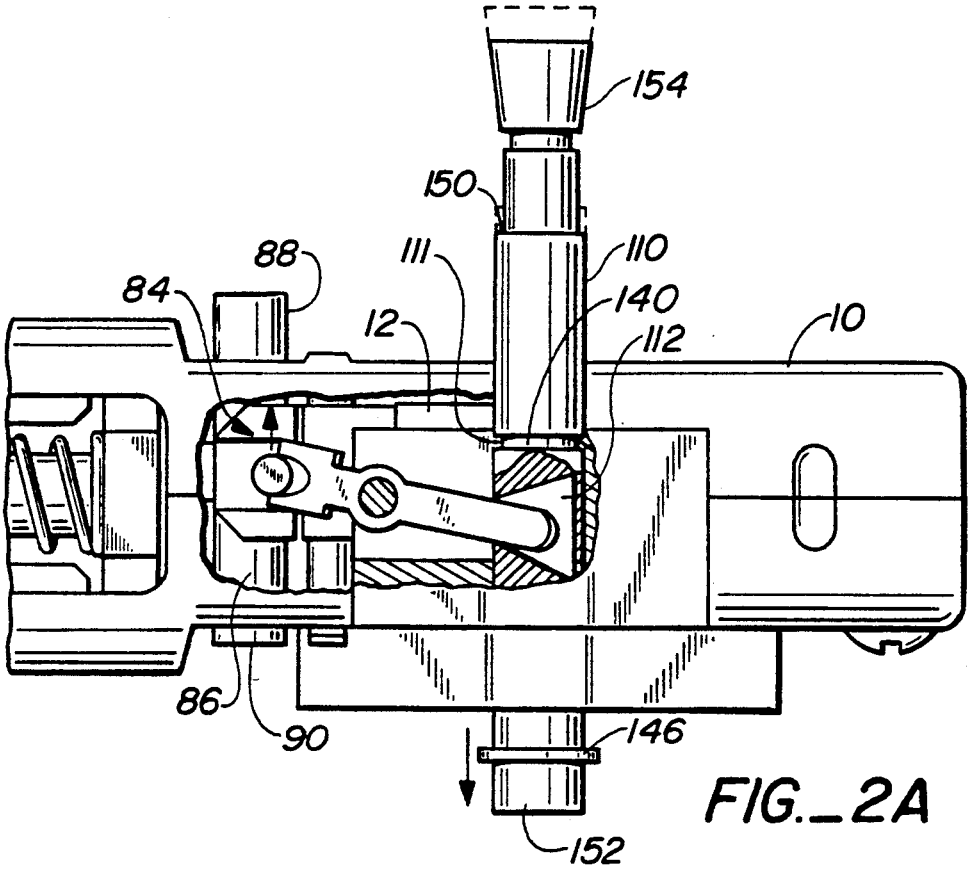
FIGS. 2A and 2B are enlarged, partial sectional, plan views illustrating selected components of the latch device in alternate positions.
Figure 2B:
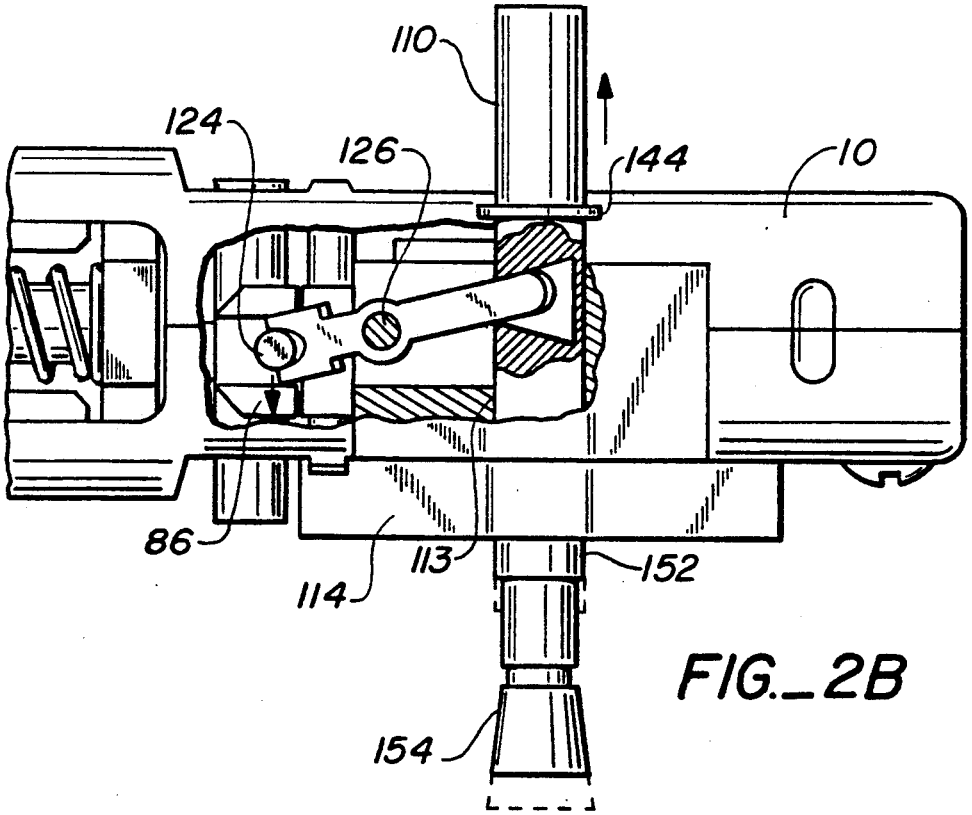
Figure 2C:
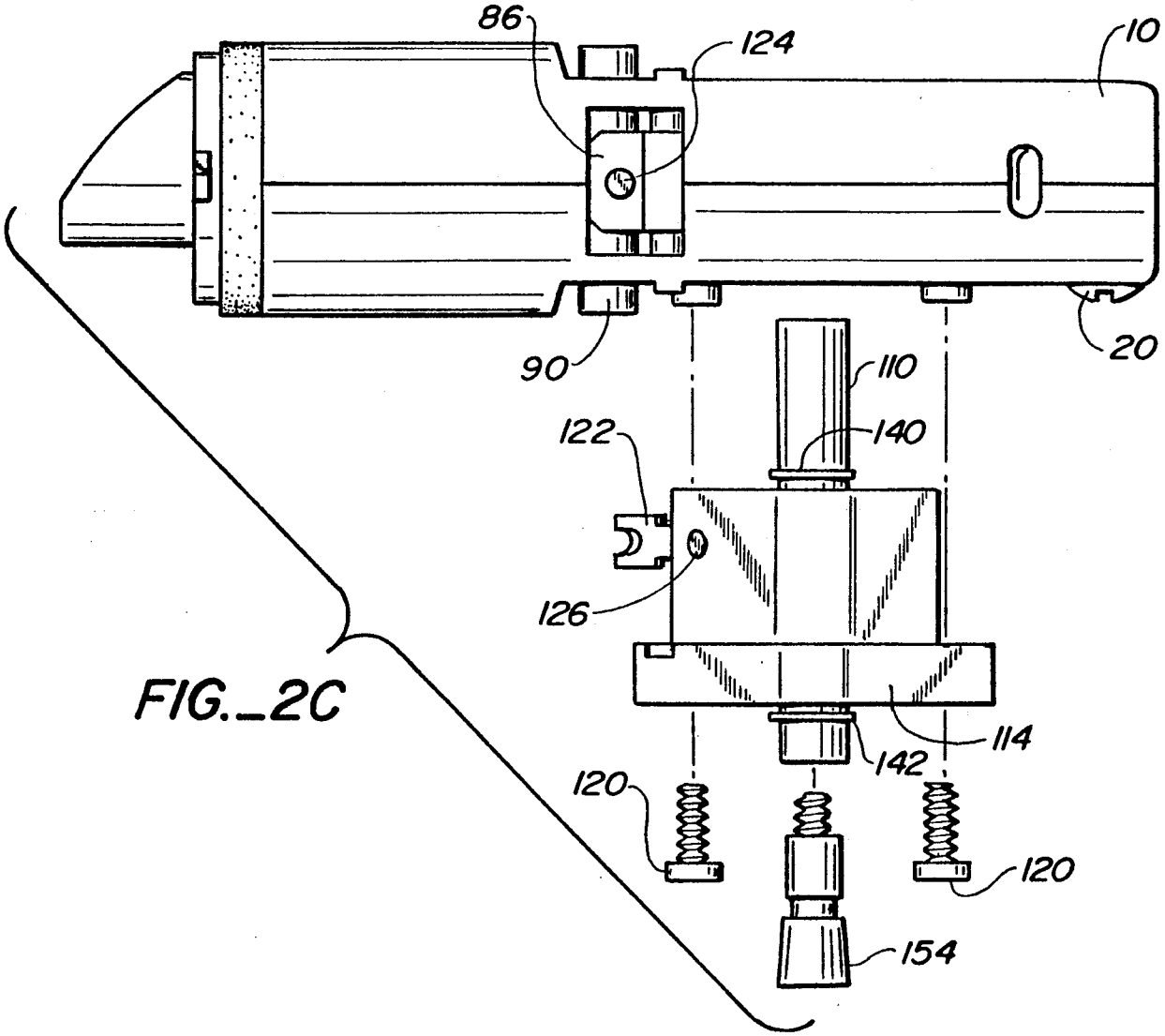
FIG. 2C is an exploded plan view of the latch device.
Figure 5:
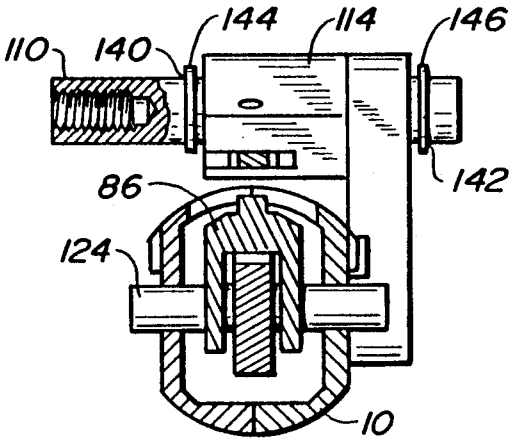
FIG. 5 is a cross-sectional view of the latch device of the present invention taken along line 5—5 of FIG. 2.

Shaft 110, as illustrated in FIGS. 2A and 2B, defines a recess 112. Shaft 110 is slidably disposed in two spaced apertures 111 and 113 defined by a mounting member 114 which is secured to housing 10. The mounting member 114 has leg elements 116, 117 and the means utilized to secure the mounting member 114 to the housing 10 comprises screw-type fasteners 120 passing through apertures (not shown) in the leg elements and matingly engaging screw threads formed in the housing.

A linkage arm 122 has one end thereof positioned in recess 112. That end of linkage arm 122 therefore will move with shaft 110. The other end of linkage arm 122 is connected to control element 86. In particular, a pin 124 projecting from control element 8 is disposed in an indent formed at the end of linkage arm 122 remote from shaft 110.

Linkage arm 122 is pivotally disposed on a pivot element in the form of a pin 126 affixed to housing 10. It will be appreciated that with such an arrangement axial movement of shaft 110 in a given direction will result in opposite axial movement of control member 84. FIGS. 2A and 2B show the relative positions assumed by the control member and the shaft 110 when the shaft 110 has been pushed to its two opposite extreme positions. When shaft 110 is in its first position shown in FIG. 2A, control element 86 is closely adjacent to housing wall 17. When the shaft 110 has been pushed into its second position shown in FIG. 2B, on the other hand, the control element 86 is closely adjacent to side 19.

With the arrangement just described, one wishing to actuate the privacy lock feature can do so merely by pushing shaft 110 in the direction of the housing, greatly adding to the convenience and usefulness of the latch device.

In contrast with the device disclosed in U.S. patent application Ser. No. 466,993 now U.S. Pat. No. 4,997,220, the present invention incorporates lock means operatively associated with said mounting member and shaft for selectively preventing said actuation mechanisms from being operatively associated with the latch element. More specifically, shaft 110 defines spaced peripherally extending grooves 140, 142. When the shaft 110 is located in an intermediate position (shown in FIG. 2) between its first and second positions described above, the grooves 140, 142 are disposed externally of the mounting member 114 and closely adjacent to the opposed sides of the mounting member.

Grooves 140 and 142, respectively, are adapted to receive therein locking elements in the form of split deformable retention rings or C-clips 144, 146 formed of spring steel or the like, such elements being of well known construction. Retention rings 144, 146 may be selectively snapped in or out of the grooves by the operator, either manually or by means of a suitable tool such as a pliers (not shown).

When grooves 140, 142 both accommodate a retention ring or clip as shown in FIG. 2, shaft 110 cannot be moved axially by pushing (or by pulling, for that matter) from its intermediate position since the rings will engage the walls of mounting member 114 when this is attempted.

Upon installation of the latch device on a door, however, the installer removes one of the rings from shaft 110, the ring being removed depending upon which side of the door one wishes to allow the user to actuate the privacy lock by pushing. For example, FIG. 2A shows the condition which exists when ring or clip 144 has been removed from groove 140. In this situation, the privacy lock feature may be actuated by pushing end 150 of shaft 110. It cannot be activated by pushing end 152 of shaft 110.

On the other hand, if clip 146 is removed and clip 144 remains in place, as shown in FIG. 2B, the privacy lock may be actuated by pushing end 152 but not by pushing end 150.

Thus, the present arrangement provides a quick and easy means for ensuring that the privacy lock can only be activated from the desired door side. This is particularly desirable when the latch device employs a latch body which may be rotated to alternate positions as disclosed in U.S. patent application Ser. No. 392,564 now U.S. Pat. No. 4,974,883.

Shaft 110 defines threaded recesses at its opposed ends 150, 152. These recesses alternatively accommodate the threaded end of a manually graspable extension element 154, depending of course upon which end of the shaft is the primary lock actuating end, that is, the end which is pushed to actuate the privacy lock.

What is claimed is:

1. In a latch device including a housing having opposed sides and defining an interior and an opening at one end of the housing communicating with said interior, a latch element disposed in said housing interior and including a latch body and a latch head, said latch element movable between an extended position and a retracted position, means operatively associated with the latch element for moving the latch element from said extended position to said retracted position, said latch element moving means including first and second actuator mechanisms selectively operatively associated with said latch element to move said latch element to said retracted position, and a reciprocatable control member movable along a first predetermined path of movement extending between said housing opposed sides for controlling which of said actuator mechanisms is operatively associated with said latch element, the improvement comprising:

a mounting member attached to said housing and defining spaced apertures;

a shaft projecting through said spaced apertures and manually accessible from outside said mounting member for moving said control member, said shaft mounted on said mounting member for axial reciprocatable movement in a direction generally opposed to the direction of movement of said control member; and lock means operatively associated with said mounting member and shaft for selectively preventing at least one of said actuator mechanisms from being operatively associated with said latch element.

2. The latch device according to claim 1 wherein said shaft is mounted on said mounting member for reciprocatable movement between a first position wherein said first actuation mechanism is operatively associated with said latch element and a second position wherein said second actuator mechanism is operatively associated with said latch element, said lock means being selectively operable to prevent said shaft from moving from a position intermediate said first and second positions to a preselected one of said first and second positions.

3. The latch device according to claim 2 wherein said lock means includes a pair of spaced locking elements selectively mountable on said shaft at spaced locations closely adjacent said mounting member external of said mounting member when said shaft is in said intermediate position, each said locking element when mounted on said shaft engaging said mounting member and preventing movement of said shaft in an axial direction toward one of said first or second positions from said intermediate position.

4. The latch device according to claim 3 wherein said shaft defines grooves at said spaced locations and wherein at least one of said locking elements is selectively positionable in one of said grooves.

5. The latch device according to claim 4 wherein at least one of said locking elements comprises a deformable retention ring selectively positionable in one of said grooves.

6. The latch device according to claim 1 wherein said shaft defines threaded recesses at opposed ends of said shaft and wherein said latch device additionally comprises a manually graspable extension element alternatively threadedly engageable with said shaft opposed ends within said threaded recesses.

* * * * *